US007380881B2

(12) United States Patent
Freed et al.

(10) Patent No.: US 7,380,881 B2
(45) Date of Patent: Jun. 3, 2008

(54) ERGONOMICALLY RESPONSIVE CHAIR

(76) Inventors: William L. Freed, 3 Shadowood La., Trumbull, CT (US) 06611; Seth Foster Eisenberg, 939 Springview Dr., Endicott, NY (US) 13760

( * ) Notice: Subject to any disclaimer, the term of this patent is extended or adjusted under 35 U.S.C. 154(b) by 576 days.

(21) Appl. No.: 10/869,493

(22) Filed: Jun. 15, 2004

(65) Prior Publication Data

US 2005/0280301 A1 Dec. 22, 2005

(51) Int. Cl.
*A47C 1/00* (2006.01)

(52) U.S. Cl. ..... 297/318; 297/317; 297/322; 297/339; 297/337

(58) Field of Classification Search ..... 297/316, 297/317, 318, 320, 322, 341, 337, 339
See application file for complete search history.

(56) References Cited

U.S. PATENT DOCUMENTS 2,725,921 A * 12/1955 Markin ..... 297/216.15
3,489,459 A * 1/1970 Katan, Jr. et al. ..... 297/316
3,982,785 A * 9/1976 Ambasz ..... 297/160
4,422,690 A * 12/1983 Kopich ..... 297/341
4,491,366 A * 1/1985 Silber ..... 297/329
4,761,033 A * 8/1988 Lanuzzi et al. ..... 297/300.3
4,842,333 A * 6/1989 Meiller ..... 297/318
5,035,466 A * 7/1991 Mathews et al. ..... 297/337
5,067,483 A 11/1991 Freed
5,099,831 A 3/1992 Freed
5,577,811 A 11/1996 Ogg
5,580,127 A 12/1996 Piretti
5,944,382 A 8/1999 Ambasz
6,609,755 B2 8/2003 Koepke et al.
6,616,231 B2 9/2003 Koepke et al.
6,634,711 B2 10/2003 Phillips et al.
6,641,214 B2 * 11/2003 Veneruso ..... 297/322
6,669,292 B2 12/2003 Koepke et al.

* cited by examiner

*Primary Examiner*—Sarah B McPartlin
(74) *Attorney, Agent, or Firm*—Ware, Fressola, Van Der Sluys & Adolphson LLC

(57) ABSTRACT

An apparatus—which could be a chair (10), but could also be an apparatus that supports a person in other than a seated position—comprising a moveable platform (including a seat (12) in case of a chair) urged always toward a neutral position when a person is seated or otherwise positioned on the apparatus (10). The motion of the platform/seat (12) toward and away from the neutral position is constrained so that the platform/seat (12) remains at least approximately horizontal in its orientation relative to the floor on which the apparatus/chair (10) is positioned even when traveling along a path not horizontal to the floor, i.e. e.g. along a path inclined to the floor. A method is also provided in which the apparatus/chair (10) is used to provide lower-back therapy.

24 Claims, 8 Drawing Sheets

FIG. 2A

ERGONOMICALLY RESPONSIVE CHAIR

TECHNICAL FIELD

The present invention relates generally to chair construction or other equipment on which a person can sit or position oneself in any posture, and more particularly to an ergonomically designed chair or apparatus having a platform on which a person sits or stands or is otherwise positioned and which continuously urges the platform to a neutral position in which the person's posture is generally considered healthful, while enabling the user to easily change spinal segmental relationship and benefit from spinal joint motion.

BACKGROUND ART

Numerous attempts have been made to provide chairs—especially for office use—that are comfortable, and so do not tire out the person sitting in the chair even after sitting for a long time. Especially in an office, where a person may remain seated in a chair for an extended period, there is a marked tendency for the person to slouch in the chair, i.e. to slump down so that the person slides forward on the seat and so at least the lower back of the person moves to a more reclined position. It is well known that a slouched or slumped sitting position can cause or aggravate injury to a person's back.

What generally happens is simply that as a person tires, the person slides forward in the seat of the chair into a slouched position, and, already tired, tends not to expend the energy required to again assume a correct, non-slouching posture. Also a non-tired person can voluntarily assume the slouched position and find it difficult to correct this posture.

While the prior art teaches chairs in which the seat can be tilted to make slouching more difficult, the back of the chair generally tilts also, in synchrony with the seat, and the person ends up in a partially reclined position, which is generally considered not conducive to work. Chairs in which the back does not tilt, but the seat does are especially potentially harmful.

What is needed is a chair that addresses the tendency of a person to slide forward in a chair, but does so in a way that does not rely on a tilting of the seat or the back of the chair.

DISCLOSURE OF THE INVENTION

Accordingly, in a first aspect of the invention, a method is provided for an apparatus for use by a person in a seated or other position, comprising: a platform, for supporting the person in a position, and having an allowed range of travel starting from a neutral position; and a base, for holding the platform off a floor or ground, and coupled to the platform so as to provide the allowed range of travel in which the platform moves at least horizontally over. the floor or ground toward and away from the neutral position; wherein the base is coupled to the platform so as to provide a restoring force tending to always move or hold the platform in the neutral position in respect to the base with the person supported on the platform and so always urging the platform toward the neutral position, wherein the restoring force acting on the platform in the neutral position or even only slightly displaced from the neutral position is or can be adjusted to be at least comparable to a force tending to push the platform away from the neutral position caused by the person merely sitting on or being otherwise positioned on the platform in a relaxed state, and further wherein the platform remains in an approximately horizontal orientation throughout the range of travel.

In accord with the first aspect of the invention, the restoring force acting on the platform in the neutral position or even only slightly displaced from the neutral position may be comparable to the restoring force acting on the platform at a position displaced from the neutral position by a significant portion of the range of travel of the platform. Also in accord with the first aspect of the invention, it may be sufficient to require that in order to move the platform away from the neutral position the person must use muscular effort, as opposed to simply slouching or otherwise relaxing, e.g. muscular effort to push against a backing or a wall to which the platform is held by friction or a mechanical connection, or to pull the platform by hooking the person's feet on an object, or to shift the person's weight. Also, it may be greater than a force resulting from the person merely slumping against a wall or a backing to which the platform is held by friction or a mechanical connection. Also in accord with the first aspect of the invention, the restoring force may continue to move the platform through the neutral position and further away from the allowed range of travel of the platform but for a stopping means acting when the platform is in the neutral position. Also in accord with the first aspect of the invention, the restoring force may be greater than approximately three per cent of the weight of the person. Also, it may be given approximately by the formula: $R=m(W+S)+b$, where W is the weight of the person supported by the platform, $b=-3.61$ pounds, and $m=0.057$, and S is an offset accounting for the weight of at least the platform.

Also in accord with the first aspect of the invention, the platform may be rollably or slidably coupled to the base.

Also in accord with the first aspect of the invention, the apparatus may be all or part of a chair, and the platform may comprise a seat of the chair.

Also in accord with the first aspect of the invention, the coupling of the base to the platform may be adapted so that when the platform is forced to move horizontally away from the neutral position it also moves in an upward direction.

Also in accord with the first aspect of the invention, the urging of the platform toward the neutral position may be provided by a resilient coupling of the base to the platform.

Also in accord with the first aspect of the invention, the urging of the platform toward the neutral position may be provided under the control of a controller receiving inputs from a sensor provided with the apparatus and coupled to the apparatus so as to sense and indicate when the person is on the platform.

Also in accord with the first aspect of the invention, the platform may be pivotably coupled to the base so as to pivot in a plane level to the floor or ground, and wherein the platform pivots about a line normal to the floor or ground and passing through the center of the platform.

In a second aspect, the invention gives a method for providing therapy for the lower back of a person, comprising: providing an apparatus according to the first aspect of the invention; and providing instructions to the person indicating that the person should adjust the apparatus so that the restoring force resists the person slumping when in a relaxed state, while still enabling the user to repetitiously move the platform toward and away from the neutral position.

In a third aspect of the invention, an apparatus is provided for use by a person in a seated or other position, comprising: a platform, for supporting the person in a position, and having an allowed range of travel starting from a neutral position; and a base, for holding the platform off a floor or ground, wherein the base is coupled to the platform so as to provide the allowed range of travel in which the platform moves at least horizontally over the floor or ground toward and away from the neutral position; wherein the base is coupled to the platform so as to provide that the allowed range of travel is upward when moving away from the platform for at least part of the allowed range of travel, and further wherein the platform remains in an approximately horizontal orientation throughout the range of travel.

In a fourth aspect, the invention gives a method for providing therapy for the lower back of a person, comprising: providing an apparatus according to the third aspect of the invention; and providing instructions to the person indicating that the person should adjust the apparatus so that the restoring force resists the person slumping when in a relaxed state, while still enabling the user to repetitiously move the platform toward and away from the neutral position.

BRIEF DESCRIPTION OF THE DRAWINGS

The above and other objects, features and advantages of the invention will become apparent from a consideration of the subsequent detailed description presented in connection with accompanying drawings, in which.

DETAILED DESCRIPTION OF THE INVENTION

Figure 1:
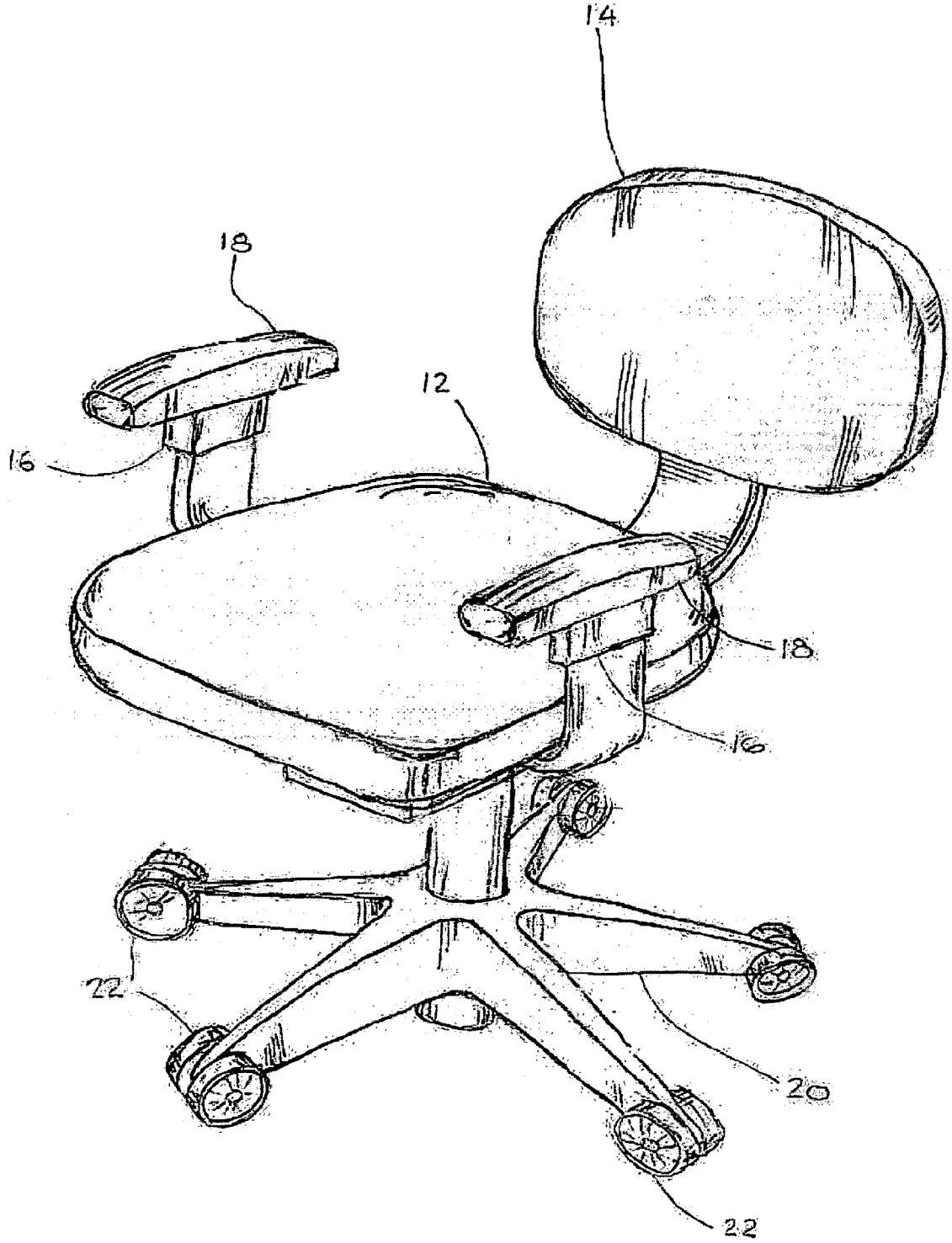
FIG. 1 is a left front perspective view of a chair according to the invention.

Referring now to the drawings, and initially to FIG. 1, an improved ergonomic chair 10 constructed according to the invention is shown comprising as its principal components a seat 12 and back 14. Suitable arms 16 having upper pads 18 may be provided. The chair 10, in a conventional manner, may be supported on a spider base 20 movable on casters 22. According to the invention, the seat 12 is provided so as to be movable, while in use by a person, toward and away from a neutral position that varies depending on the weight and weight distribution of the person, and further, is provided so as to provide a restoring force urging against the person slouching (slumping down in the chair), and so moving the seat away from the neutral position, a force, though, chosen to be small enough that slouching is still possible. The restoring force acts continuously, and so when the person slouches and so moves the seat away from the neutral position, the restoring force assists the person in returning to a more upright posture, with the seat back in its neutral position; for that reason, the chair may be characterized as ergonomically responsive. The restoring force acts continuously, even when the seat is at or near the neutral position (but when in the neutral position, the restoring force is negated by a mechanical or other stop so that the seat does not move through the neutral position even closer to the back of the chair).

The aim of a chair according to the invention is to provide actual therapeutic benefit to a person using the chair, and to do so, the restoring force must be chosen judiciously, and in particular, the restoring force should be such that even at the neutral position, there is enough of a restoring force that a person does not simply immediately slump forward when first sitting down, and so move the seat away from the neutral position; the restoring force should be strong enough right at the neutral position so that the person can remain upright without hardly any more effort than would be required in a chair without a movable seat. Also, the chair seat 12 preferably moves toward and away from the neutral position independent of the orientation or motion of the seat back 14. Further, the inventors have determined that the forward and back motion of the seat 12 is preferably, for purposes of any therapeutic effect, such that the seat remains at least approximately horizontal throughout the motion.

Figure 2A:
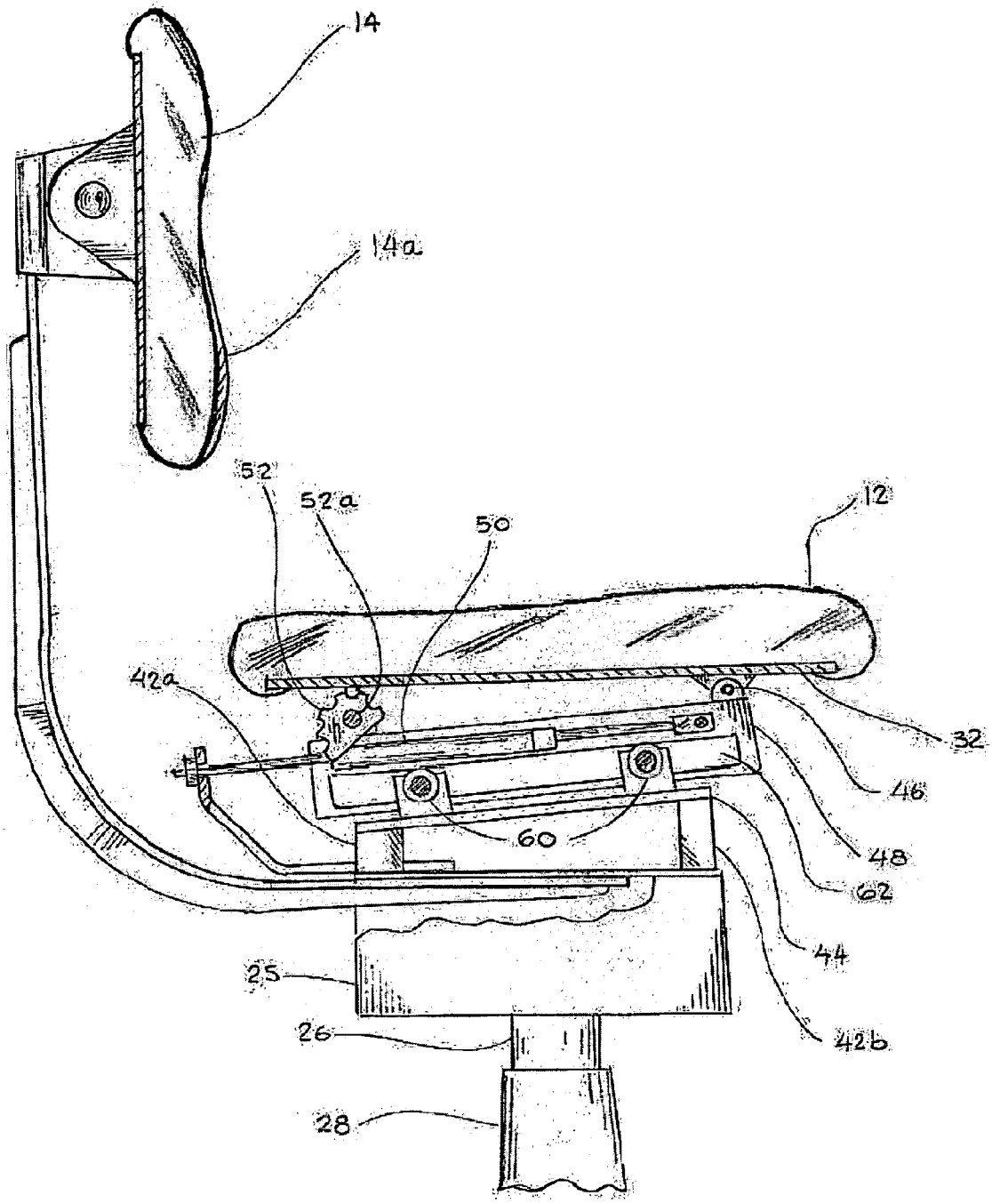
FIGS. 2A and 2B are elevation side view of the chair of FIG. 1, showing the chair with its seat in two different positions, a neutral position in FIG. 2A, and a displaced position in FIG. 2B.
Figure 2B:
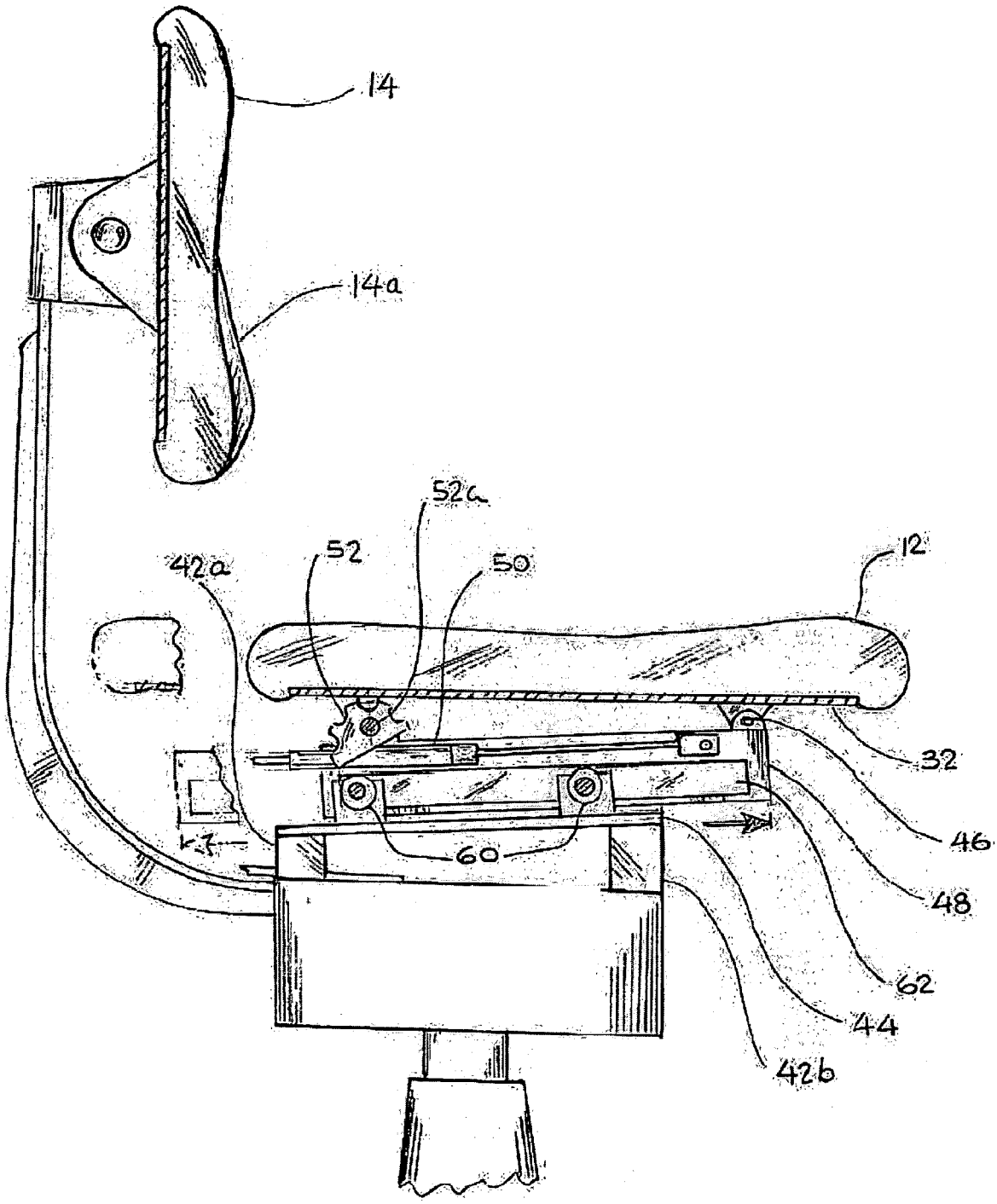
Figure 3:
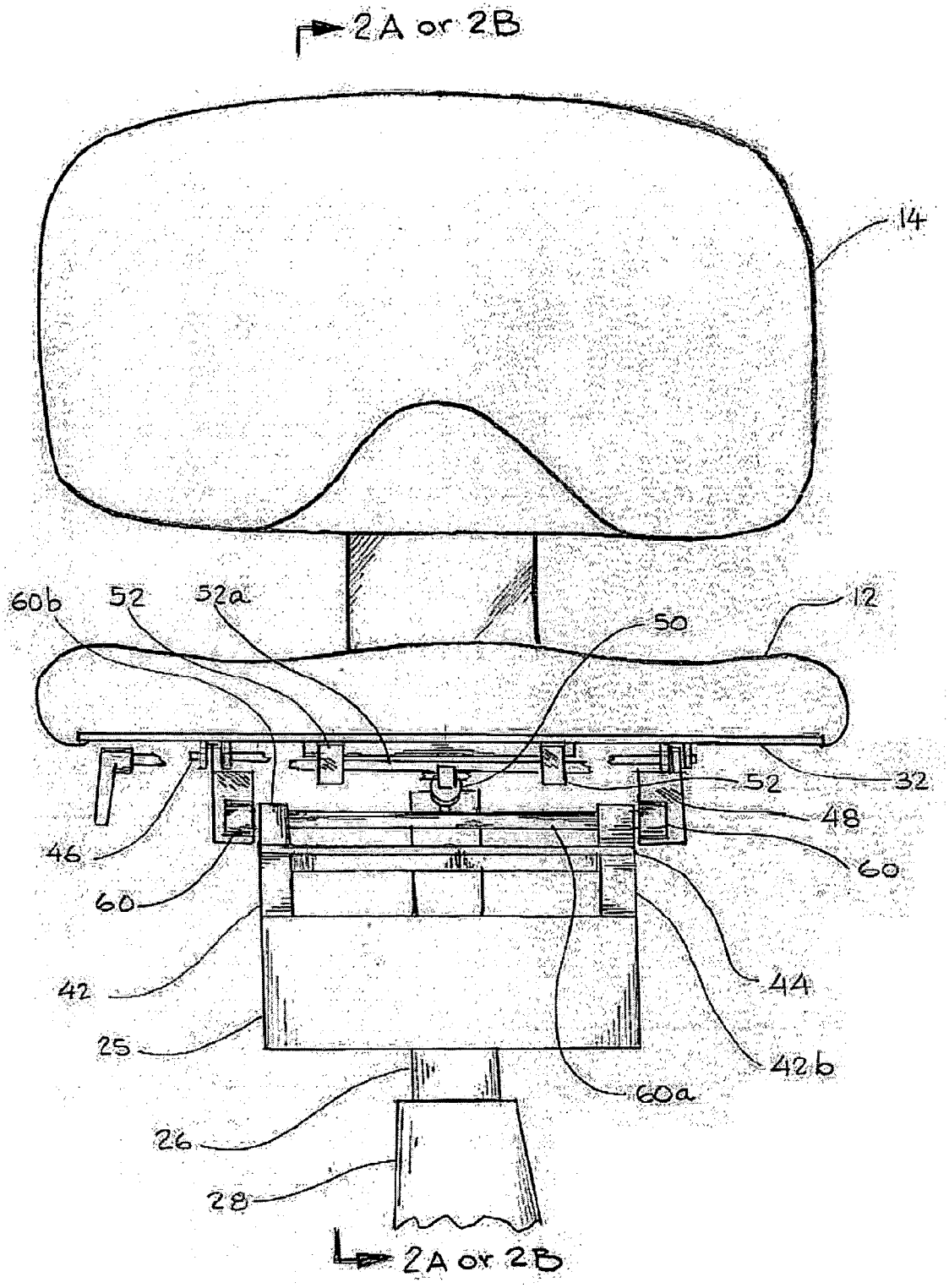
FIG. 3 is another view of the chair of FIGS. 2A and 2B.

Referring now FIGS. 2A and 2B and also FIG. 3, a particular embodiment of the invention is shown, one in which the restoring force is provided by gravity in that the seat 12 is allowed to move away from a neutral position (FIG. 2A) by traveling up an inclined plane (i.e. along a path in space that is both away from the neutral position and also upward, away from the base of the chair), or, more generally, along some upward path to a displaced position (FIG. 2B); the movement is so constrained by arranging that (moveable) rails 48, inclined at an angle relative to the local horizontal, roll over rollers 60—coupled in pairs by axles 60*a* supported by supports 60*b*—rotatably held fixed at the angle with respect to the local horizontal and disposed so as to support the rails 48 from within rail slots 62 in the rails. Thus, the seat 12, attached to the rails 48, is moveable along an inclined plane toward and away from the neutral position (FIG. 2A). When a person using the chair moves the seat away from the neutral position at the bottom of the upward path, there is of course a continually acting restoring force so that the person is in effect assisted in returning to a more upright posture.

It is of course apparent that the rails 48 can be made to slide instead of roll along the rail slots 62, but what is important is that if the seat slides toward and away from the neutral position instead of rolling on rollers, the sliding must be easy to start, and must require little or no effort to continue, since in order to maximize the benefit from using a chair according to the invention, a person should continually move the seat toward and away from the neutral position, and so little or no effort should be required, i.e. the seat should be moveable without conscious effort, just as rocking in a rocking chair is continued without conscious effort. Thus, any mating surfaces providing a slidable coupling of the rails to the rail slots should have a quite low coefficient of static friction and also a quite low coefficient of dynamic friction, and should of course also have appropriate wear properties, so as to endure the sliding back and forth motion for thousands of hours when a person of ordinary weight is seated in the chair.

As shown in FIGS. 2A and 2B and also FIG. 3, a chair 10 according to the invention has a seat pan 32 to which the seat 12 is attached, and which in turn is pivotally attached to a rail 48 via a seat pan pivot 46. The rail 48 is inclined at an angle relative to the floor on which the chair rests (on its casters 22), i.e. the local horizontal. Assuming that gravity acts generally perpendicular to the local horizontal or floor, and downward through the seat of the chair toward the floor, to push the seat 12 along the rails 48 away from the position in which the seat is rearward, closest to the back 14, is to push the seat generally uphill, and so requires overcoming a fraction of the force of gravity (serving as the restoring force in this embodiment), the fraction depending on the angle the rails make with the floor.

Importantly, as noted above, the (restoring) force to be overcome is (or can be adjusted to be) substantial even when the seat is at or near the neutral position, in that even when the seat is at or near the neutral position, the restoring force is—or can be adjusted to be—at least comparable to a force tending to push the seat away from the neutral position and caused by a person merely sitting on the seat in a relaxed state. At the same time, it is important to understand that the seat 12 should not too aggressively resist—by virtue of the restoring force it provides—a person slouching in the chair, because if the force resisting slouching is too great, the person will actually slip across the surface of the seat, and so lose the advantage of the chair urging the person back into a correct posture.

In some embodiments, the restoring force acts with comparable magnitude when the seat is at or near its neutral position (FIG. 2A) and when the seat has been moved a short distance (an inch or so) away from the neutral position or even, in some embodiments, when it is displaced from the neutral position by a significant portion of its range of travel, and so has been moved partly uphill (in a position intermediate between the neutral position and the substantially displaced position of FIG. 2B). In some embodiments, such as the inclined plane embodiment described above, but also in case of using a spring (such as a gas spring) for providing the restoring force), with the spring in an extended/stretched state even when the seat is at the neutral position, the restoring force would continue to move the seat (through the neutral point) but for a stopping means (e.g. a mechanical stop) acting when the seat is in the neutral position. Another way to understand whether the restoring force is adequate according to the invention is to determine whether the restoring force acting on the seat in the neutral position or even only slightly displaced from the neutral position is sufficient to require that in order to move the seat away from the neutral position a person must push against the seat back and/or utilize hamstring muscles and pull the seat away from the wall (by holding onto the floor with the feet, or hooking the feet onto some protuberance on the chair), as opposed to simply slumping in the chair.

The restoring force is advantageously adjustable so that people of different weights can use the chair in its most beneficial mode with substantially the same ease. As described above, the restoring force should stop slumping forward, but should not be so strong as to cause a person to slip on the seat when trying to push the seat away from the neutral position.

The inventors have made measurements of the restoring force deemed by the inventors to be suitable for people of different weight, in order to provide some (very approximate and disregarding mass distribution) objective guidance in respect to the desirable magnitude of a restoring force. According to the measurements, as a rough rule of thumb, the restoring force at or near the neutral position can be given by the formula:

$$R=m(W+S)+b,$$

where W is the weight of the person seated on the chair, b=−3.61 pounds, and m=0.057 (dimensionless, i.e. a pure number), and S is the weight of the seat 12 and seat pan 32 (and other moving components), which in the measurements actually made amounted to approximately 25 pounds. This equation is consistent with measurements by the inventors in case of a 170-pound person on the seat and also for a 70-pound person on the seat. What the inventors actually measured is that 7.5 pounds is required to prevent initial seat pan glide for a 170-pound relaxed sitter (and with the restoring force so adjusted 0.8 pounds was required to initiate seat pan glide without a sitter). To move the seat with a 70-pound weight on the seat required 1.8 pounds. To return to the neutral position after the seat had traveled only a slight distance from the neutral position, 9-12 pounds of force was required for the 170-pound relaxed sitter, which is therefore approximately the force when the seat is at or near the neutral position. Thus, according to the measurements made by the inventors, the restoring force is advantageously adjusted to a value that is at least nominally 4-6% of the weight of an average-weight sitter (but a higher percentage for a lighter-weight person).

Still referring to FIGS. 2A, 2B and 3, in the embodiment shown there the rollers 60 are rotatably held in place by features of a roller fixture 44, which in turn is held at the desired angle of the inclined plane (with respect to the local horizontal) by a short post 42*a* closer to the seat back 14, and a tall post 42*b* farther from the seat back. The short and tall posts 42*a* 42*b* attach to a central support module 25 to which the seat back 14 is attached at an orientation that is completely independent of the orientation or position of the seat 12. The central support module 25 is rotatably connected to the spider base 20 by equipment including a hub 26 and a gas cylinder 28 for helping raise the central support module in adjusting how high off the floor it is.

Still referring to FIGS. 2A, 2B and 3, in some embodiments the tall post 42*b* or the short post 42*a* or both are adjustable in length or location, and making such an adjustment changes the angle of the seat 12 with respect to the local horizontal. After making such an adjustment of the angle of the inclined plane, if the seat pan was horizontal before adjusting the inclined plane, it is advantageous to adjust the seat pan 32 to again be at least approximately horizontal. To provide for such a seat angle adjustment, the invention encompasses having the seat pan 32 pivot about a pivot point on the rail 48, and be held at a desired pivot angle by a seat pan support 52, which can be e.g. adjustable post(s) or an out-of-round wheel rotatably attached to the rail 48 via a seat pan support pivot 52*a*, as shown in FIGS. 2A, 2B and 3. In another embodiment (not shown), an out-of-round wheel (i.e. a cam) is used in place of the two posts to adjust the angle of the inclined plane; in a further embodiment (also not shown), an out-of-round wheel is used for an adjustable-height post and a fixed-height post is also used. An out-of-round wheel (cam) may also be used to adjust the orientation of the seat after adjusting the angle of the inclined plane.

Still referring to FIGS. 2A, 2B and 3, in some embodiments it is advantageous to include a reverse biasing mechanism for moving the seat 12 away from the back when a person gets up from the chair 10. The mechanism should not of course be strong enough to move the seat away from the back 14 of the chair when a person (of any significant weight) sits down; in other words, the net force (the component of gravity along the inclined plane plus the force exerted by the reverse biasing mechanism) when a person sits down should be directed down the inclined plane. Such a mechanism makes it more likely that when a person sits down in the chair, the person will sit toward the back 14 of the chair, thereby maximizing the beneficial support of the lordotic contour. There may even be times when the user of the chair desires additional pressure against the lordotic contour. Furthermore this mechanism will allow for full range of lumbar spine motion from full anterior to posterior pelvic tilt, regardless of the user's initial posture. In addition, the reverse biasing mechanism—suitably implemented—can act as an equalizer, providing a way to adjust the chair so that without changing the angle of the rails 48, a heavier person can experience no more of a restoring force than a lighter person. The reverse biasing mechanism can also be helpful in increasing the benefits of posterior pelvic tilt since with the reverse biasing mechanism a user can increase the angle of the inclined plane without increasing the effort required to cause the seat to travel through the range of motion, and increasing the angle of tilt may dramatically reduce the shearing forces on the spine. For the equalizer function, the reverse biasing mechanism must be such as to provide a more or less constant reverse bias (reverse restoring force). As shown in FIGS. 2A, 2B and 3, the reverse biasing mechanism can be a gas spring 50 disposed and fixedly attached (directly or indirectly) to the central support module 25 so as to tend to push the rails 48 (and so the seat 12) away from the seat back 14 along the inclined plane defined by the angle the rails 48 make with the local horizontal. Gas springs typically include a resizable chamber filled with gas molecules, and use valving to adjust the number of gas molecules in the chamber during compression and expansion so as to provide a more or less constant restoring force (when compressed or uncompressed over some predetermined range of sizes).

Figure 4:
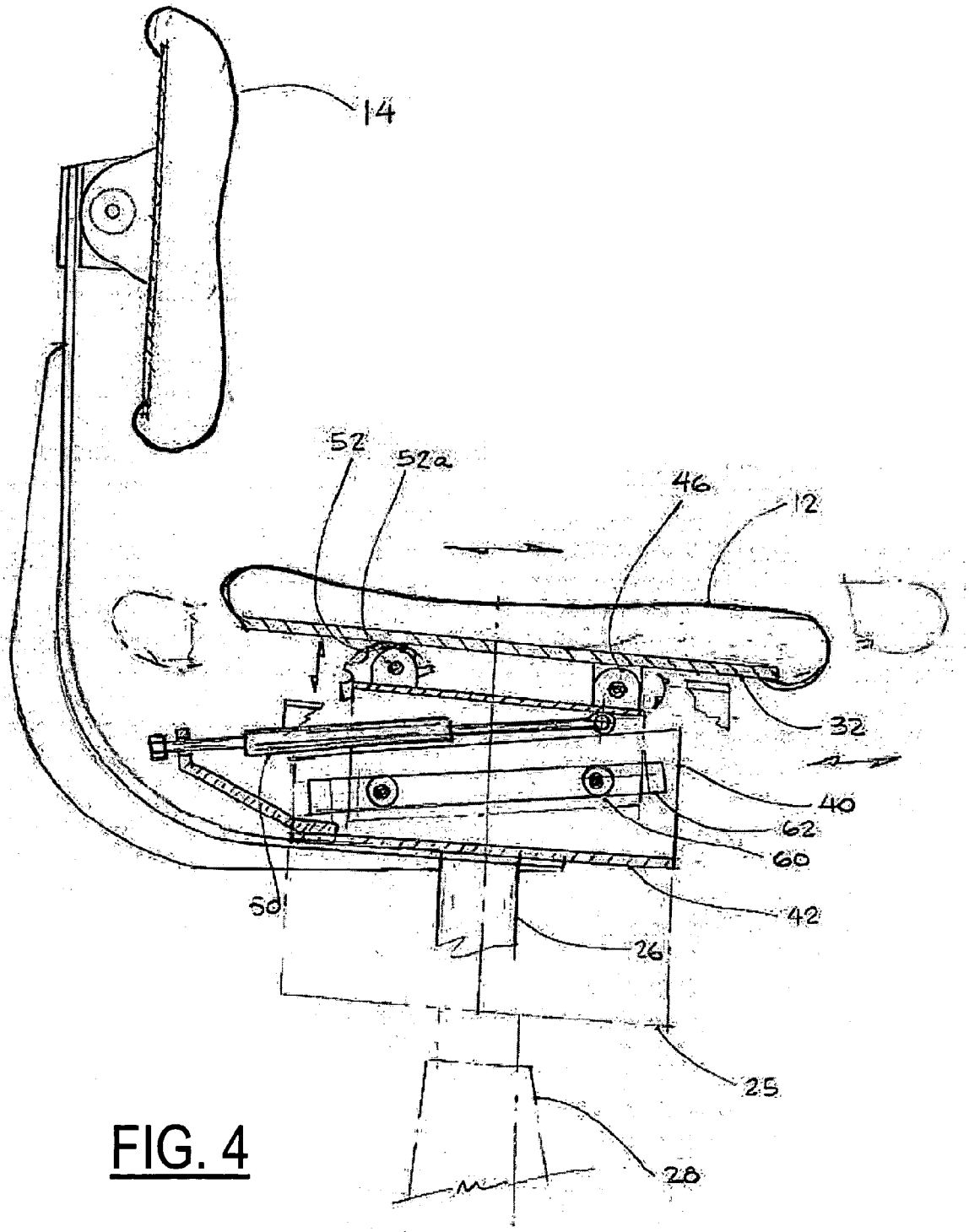
FIGS. 4-6 are views of other embodiments of a chair according to the invention, and in particular are views of embodiments in which rollers are fixedly mounted to the seat instead of to the base of the chair, as they are in the embodiments shown in FIGS. 1, 2A, 2B and 3.
Figure 5:
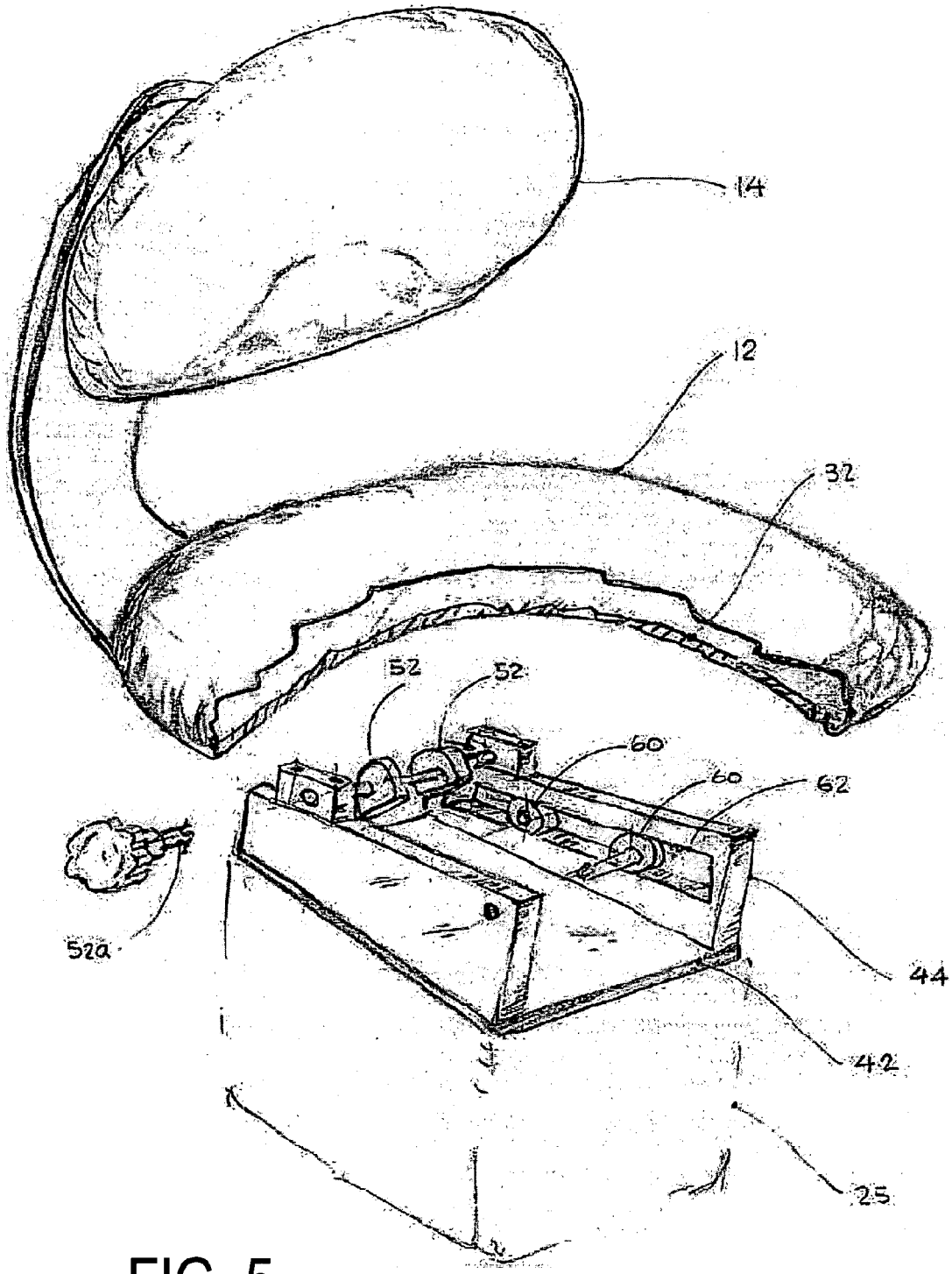
Figure 6:
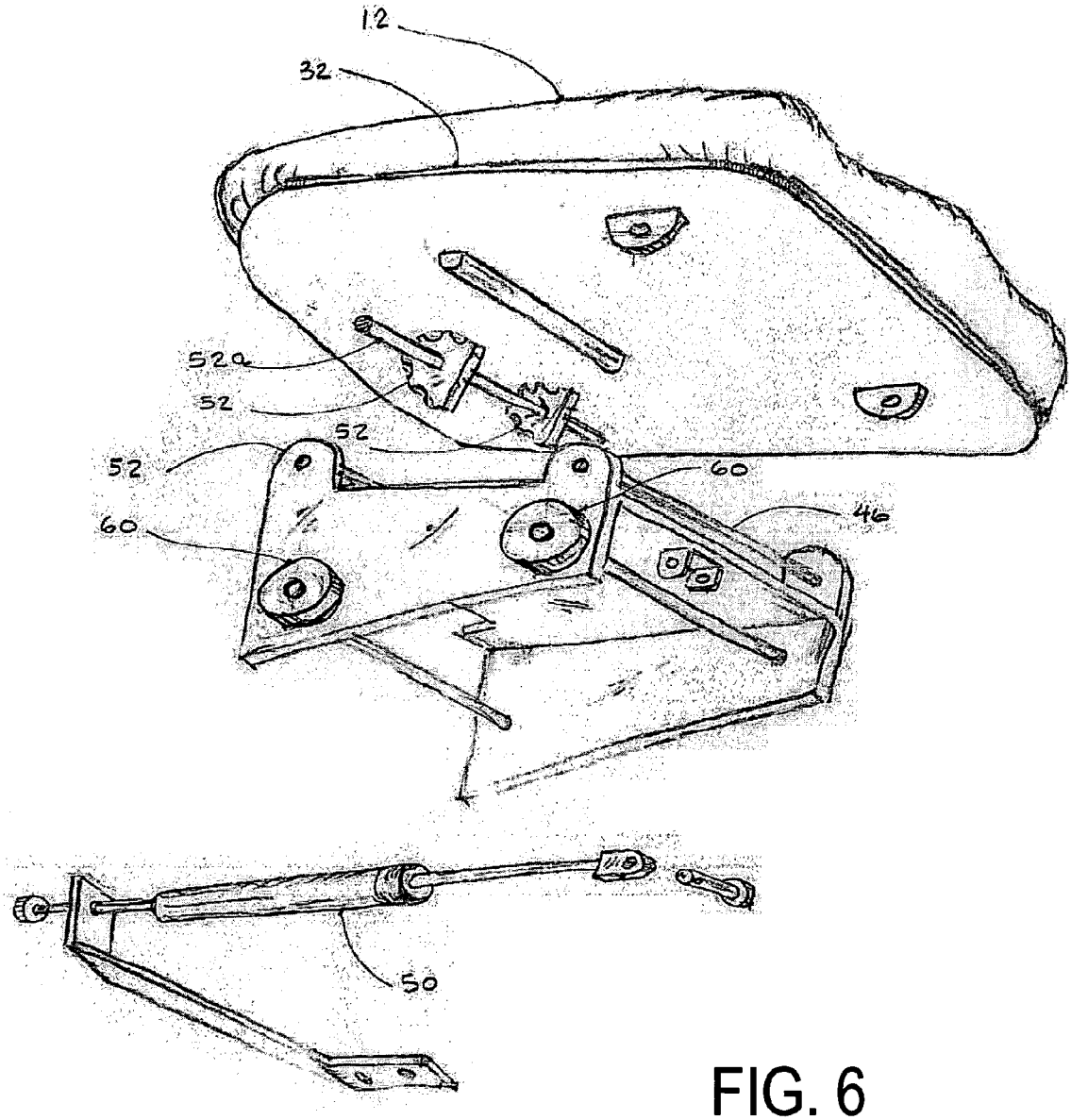

Referring now to FIGS. 4-6, embodiments of a chair according to the invention are shown in which the rollers 60 are rotatably attached to the seat pan 32, and the rail 48, roller fixture 44, and rail posts 42*a* 42*b* are combined into a single inclined plane structure 40 in which the rail slots 62 are inscribed, and the seat pan 32 moves up and down the inclined plane structure 40 via the rollers 60 rolling inside the (fixed) rail slots 62 (whereas, in the embodiment shown in FIGS. 2A, 2B and 3, the rail 48 moves over the rollers 60).

Besides embodiments in which gravity is used as a restoring force to a neutral position, the invention encompasses embodiments in which the restoring force is otherwise provided, including embodiments in which a spring mechanism is used, such as a gas spring, but adjusted so as to provide a restoring force as described above, i.e. of sufficient magnitude so that even when the seat is at or near the neutral position, a person is not likely to move the seat away from the neutral position merely by sitting in the seat in a relaxed state.

Figure 8:
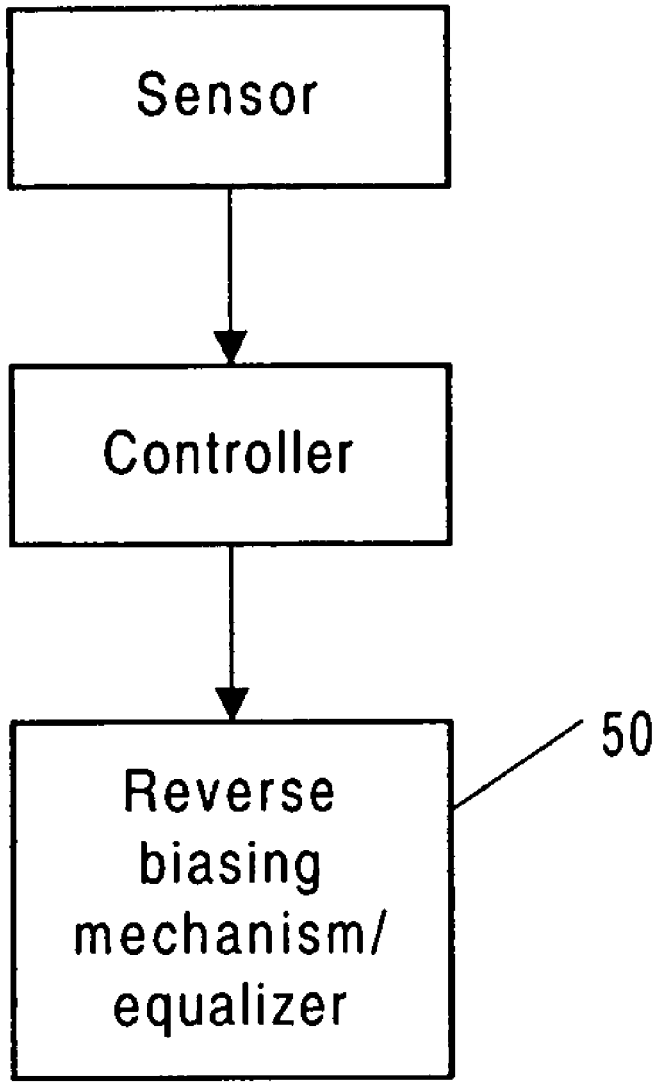
FIG. 8 is a block diagram of an embodiment of the invention including a controller.

In the case of the inclined plane embodiment, the use of a reverse biasing mechanism serving as an equalizer was described. The same can be provided in case of embodiments in which a spring mechanism is used for providing the restoring force. Some such embodiments might be described as smart chairs, and in such embodiments, and now referring to FIG. 8, the equalizer means (such as gas spring 50 of FIGS. 2A, 2B and 3) is turned on and off depending on whether a sensor in the chair detects a person sitting on the chair. A strain sensor can be used for this purpose. The sensor output can be provided to a controller, which activates or deactivates the equalizer means appropriately, and can even control the amount of force exerted by the equalizer means (which would of course be useful to do in case of inclined plane embodiments also). In smart chair embodiments, even in spring mechanism embodiments as opposed to inclined plane embodiments, the reverse biasing mechanism can be controlled so as to push the seat forward when a person gets up off the chair. Then when a person sits down on the chair, the seat is forward, but the controller regulates the reverse biasing mechanism (or instead regulates the forward restoring force means, or coordinates both) so that the net force—restoring force less reverse biasing force provided by the reverse biasing mechanism—is toward the neutral position. Thus, when seated on the chair, according to the invention there is always a force tending to move the seat toward the neutral position, whether gravity is used to provide the restoring force (in an inclined plane embodiment) or a spring mechanism is used.

It should be appreciated that only some possible embodiments of the invention are shown and described, especially in respect to how to provide a restoring force, and, in the inclined plane embodiment, how to change the angle of the inclined plane and to level the seat after doing so.

In some embodiments a seat of a chair according to the invention advantageously pivots about the center of the seat, regardless of where the seat is along its path of travel. In such embodiments, therefore, the central support module 25 can be configured to rotate on the hub 26 only after the range of pivoting of the seat is exhausted, i.e. so that a certain minimum torque is required for the central support module 25 to rotate on the hub 26.

That the invention provides some health benefits in effect to the spine can be understood in terms of the effect of the unique motion the seat has in the present invention. The chair facilitates all possible spinal motion (in all planes). In addition by having the seat remain relatively horizontal to the floor, the lumbar spine can experience the full range of motion with minimal effort. Periodic changing of the spinal position can result in a relieving or reducing of stress on the ligaments and joints between the spinal segments as well as the discs. In addition, because the seat does allow easy movement toward and away from a neutral position, as a person moves the seat back and forth, there is a tendency for the discs to imbibe and express fluid enhancing nourishment and the removal of waste products.

Although the above invention has been described in terms of a chair, it should be understood that it is also possible for the invention to be used as a platform a person stands on or on which a person assumes any other posture, in which case there is no need for any sort of a back, but only the platform and means for moving the platform toward and away from a neutral position, always with an urging back toward the neutral position at least when a person is on the platform. The platform can then be placed near a wall and a person can stand (or assume another posture) on the platform so as to position different portions of the person's torso against the wall and allow the platform to move the person's distal anatomy (e.g. the person's feet, depending on how the person is positioned on the platform) away from the wall and back again, and to repeat away-and-back-again motion over and over again. The movement can be accomplished by the person pushing against the wall or on any other object to which the platform is attached or relative to which the platform is relatively fixed in position. (There are of course other ways for a person to move the platform, including, at least in case of a chair, using the muscles to shift the weight distribution and so move the seat—which is part of the weight distribution since the person is "attached" to the seat by friction—or by the person using their feet to pull on the floor and so draw the seat away from the neutral position, or even just shifting their weight and so causing the seat to move.) The result of the repetitive movement of the platform can be the nourishing of discs and other joints, as mentioned above.

The inventors have observed that compression fractures can be treated using the invention. To most efficaciously treat compression fractures, a person would raise the back of the seat of a chair incorporating the invention so as to allow sitting on a chair with the buttocks travelling past the back of the chair and so greatly accentuating the concavity of the lower spine. Such an arrangement in effect amplifies the "fist in the back" (or more accurately, the segmental spinal extension) sensation the invention can provide in the case of incorporating it into a chair having a back with a protruding lower section (as described above in respect to FIGS. 2A, 2B and 3). For the amplified effect in case of, for example, treating compression fractures, the chair could be provided without the protruding lower section of the back, and instead with more of a plane back, and the back of the chair would be raised up to provide a space between the bottom of the back of the chair and the top of the seat, and it would be the bottom of the back of the chair that would line up with the persons back where the spine is to be isolated.

Note that the "fist in the back"/additional pressure against the contour of the chair sensation can be provided with an embodiment of the invention using a spring for providing the restoring force and without using what might be called a smart chair. To arrange for the additional pressure against the contour of the chair sensation with a spring restoring force and without relying on sensors to determine when a person is sitting in a chair according to the invention, a lever can be provided to engage or disengage a secondary spring that provides a force greater than that provided by the restoring force, and so pushes the chair away from the neutral position. Such a lever could be pulled before or after a person gets off the chair.

Figure 7:
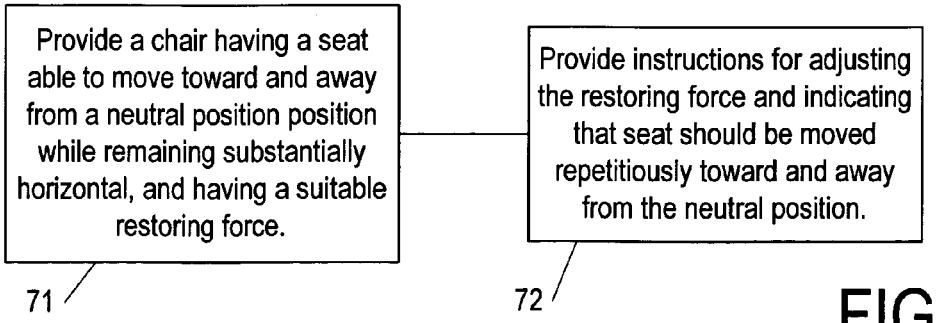
FIG. 7 is a flowchart showing a method according to the invention of providing therapy for a person's back (using a chair according to the invention).

Referring now to FIG. 7, from the above description, it should be apparent that the invention also encompasses a method for providing therapy for the lower back of a person, comprising a step 71 of providing a chair or platform and base as described above, and also a step 72 of providing instructions indicating that a person should adjust the apparatus so that the restoring force resists the person slumping when in a relaxed state, and should then sit or position oneself on the platform and repetitiously move the platform toward and away from the neutral position. As explained above in case of a chair, the motion of the seat—its remaining at least approximately horizontal as it is moved toward and away from the neutral position—appears to be beneficial for the lower spine, an effect which is theorized by the inventors to result from increased circulation to the spine caused by the motion of the seat (as long as the seat remains at least approximately horizontal, even though moving up and down an inclined path) and by redistribution of weight bearing surfaces.

It is to be understood that the above-described arrangements are only illustrative of the application of the principles of the present invention. Numerous modifications and alternative arrangements may be devised by those skilled in the art without departing from the scope of the present invention, and the appended claims are intended to cover such modifications and arrangements.

What is claimed is:

1. An apparatus for use by a person in a seated or other position on a platform, comprising:

a base, for supporting the platform, and adapted for coupling to the platform by rolling or low-friction sliding engagement so as to allow repetitive travel of the platform toward and away from a neutral position over an allowed range of travel in response to forces exerted by the person via the platform, wherein in the allowed range of travel the platform moves at least horizontally toward and away from the neutral position;

wherein the coupling of the base to the platform is such as to provide a restoring force tending to always move or hold the platform in the neutral position in respect to the base with the person supported on the platform and so always urging the platform toward the neutral position, wherein the coupling of the base to the platform is so that the restoring force acting on the platform in the neutral position or even only slightly displaced from the neutral position is adjustable so as to be at least comparable to a force tending to push the platform away from the neutral position caused by the person merely sitting on or being otherwise positioned on the platform in a relaxed state, and further wherein the coupling of the base to the platform is so that the platform remains in a substantially horizontal orientation throughout the range of travel, and the orientation does not changes so that the platform remains level while the platform moves throughout the range of travel;

wherein the coupling of the base to the platform comprises an adjustable post.

2. An apparatus as in claim 1, wherein the restoring force acting on the platform in the neutral position or even only slightly displaced from the neutral position can be adjusted to be comparable to the restoring force acting on the platform at a position displaced from the neutral position by a significant portion of the range of travel of the platform.

3. An apparatus as in claim 1, wherein the restoring force acting on the platform in the neutral position or even only slightly displaced from the neutral position can be adjusted to be sufficient to require that in order to move the platform away from the neutral position the person must push against a backing or a wall to which the platform is held by friction or a mechanical connection.

4. An apparatus as in claim 1, wherein the allowed range of travel has a distal end away from the neutral position and a proximate end at the neutral position, and the restoring force acting on the platform in the neutral position can be adjusted so as to tend to move the platform from the distal end to the proximate end through the neutral position and outside the allowed range of travel of the platform but for a mechanical stop disposed at the neutral position, whereby the restoring force is of a non-zero magnitude even when the platform is located at the neutral position.

5. An apparatus as in claim 1, wherein the apparatus is included in a chair of which the platform serves as a seat.

6. An apparatus as in claim 1, wherein the coupling of the base to the platform is adapted so that when the platform is forced to move horizontally away from the neutral position it also moves in an upward direction for at least some portion of the allowed range of travel along a path making an angle with respect to the horizontal.

7. An apparatus as in claim 6, wherein the coupling of the base to the platform comprises means for adjusting the angle of the path and means for adjusting the angle of the platform so as to allow maintaining the platform in an approximately horizontal orientation after adjusting the angle of the path.

8. An apparatus as in claim 6, wherein the coupling of the base to the platform comprises rollers rotatably coupled to either the base or the platform, and rail slots inscribed in a rail for engaging the rollers, with the rollers and rail slots disposed so that the rollers are constrained to move along a path that is generally upward when the platform is moving away from the neutral position.

9. An apparatus as in claim 6, wherein the coupling of the base to the platform is adapted to urge the seat in a horizontal and also upward direction when the seat is not load-bearing so as to tend to position the platform up and away from the neutral position when the person is not supported on the platform.

10. An apparatus as in claim 1, further comprising the platform, wherein the platform is rotatably coupled to the base so as to be rotatable in a plane level to the horizontal.

11. An apparatus for use with a platform for supporting a person in a seated or other position, comprising:

a base, for supporting the platform, and adapted for coupling to the platform by rolling or low-friction sliding engagement so as to allow repetitive travel of the platform at least horizontally toward and away from a neutral position over an allowed range of travel in response to forces exerted by a person via the platform;

wherein the base is adapted for coupling to the platform so as to provide that the allowed range of travel is also upward when moving away from the neutral position for at least part of the allowed range of travel so that gravity acts as a restoring force when the platform is moved away from the neutral position, and further wherein the coupling of the platform to the base is so that the platform remains in a substantially hirizontal orientation throughout the range of travel and the orientation does not changes so that the platform remains level while the platform moves throughout the range of travel;

wherein the coupling of the base to the platform comprises an adjustable post.

12. An apparatus as in claim 11, wherein the adjustable post comprises means for adjusting the angle of inclination of a path along the range of travel with respect to the horizontal, and means for adjusting the orientation of the platform so as to allow maintaining the platform in an approximately horizontal orientation after adjusting the angle of inclination of the path.

13. An apparatus as in claim 11, further comprising the platform, wherein the platform is rotatably coupled to the base so as to be rotatable in a plane level to the horizontal.

14. An apparatus as in claim 11, wherein the coupling of the base to the platform further comprises means for urging the seat in a horizontal and also upward direction when the seat is not load-bearing so as to tend to position the platform up and away from the neutral position when the platform is not load-bearing.

15. An apparatus as in claim 11, wherein the coupling of the base to the platform further comprises means for making operable a force urging the platform away from the neutral position so as to enable positioning the platform away from the neutral position when the person is not supported on the platform.

16. An apparatus as in claim 11, further comprising a gas spring for providing an adjustable reverse biasing force countering the restoring force, so as to provide a net restoring force that is comparable for different people of different weight.

17. A chair, comprising a seat back, a platform, and also comprising an apparatus as in claim 1 and so including a base, wherein the base is coupled to the platform, and is also coupled to the seat back, and further comprising legs coupled to the base, for supporting the base.

18. A chair, comprising a seat back, a platform, and also comprising an apparatus as in claim 11 and so including a base, wherein the base is coupled to the platform, and is also coupled to the seat back, and further comprising legs coupled to the base, for supporting the base.

19. An apparatus for use by a person in a seated or other position on a platform, comprising:

a base, for supporting the platform, and adapted for coupling to the platform by rolling or low-friction sliding engagement so as to allow repetitive travel of the platform toward and away from a neutral position over an allowed range of travel in response to forces exerted by the person via the platform, wherein in the allowed range of travel the platform moves at least horizontally toward and away from the neutral position;

wherein the coupling of the base to the platform is such as to provide a restoring force tending to always move or hold the platform in the neutral position in respect to the base with the person supported on the platform and so always urging the platform toward the neutral position, wherein the coupling of the base to the platform is so that the restoring force acting on the platform in the neutral position or even only slightly displaced from the neutral position is adjustable so as to be at least comparable to a force tending to push the platform away from the neutral position caused by the person merely sitting on or being otherwise positioned on the platform in a relaxed state, and further wherein the coupling of the base to the platform is so that the platform remains in a substantially horizontal orientation throughout the range of travel and the orientation does not changes so that the platform remains level while the platform moves throughout the range of travel;

wherein the coupling of the base to the platform comprises an adjustable spring for providing the restoring force acting on the platform in the neutral position or even only slightly displaced from the neutral position.

20. An apparatus as in claim 19, wherein the urging of the platform toward the neutral position is provided by a resilient coupling of the base to the platform.

21. An apparatus as in claim 20, wherein the coupling of the base to the platform is adapted to allow making operable a force urging the platform away from the neutral position so as to enable positioning the platform away from the neutral position when the person is not supported on the platform.

22. An apparatus as in claim 19, further comprising a controller and a sensor, wherein the urging of the platform toward the neutral position is provided under the control of the controller receiving inputs from the sensor indicating when the person is positioned on the platform.

23. An apparatus as in claim 22, wherein a reverse biasing force is provided under the control of the controller, with the controller regulating the magnitude of the reverse biasing force or the restoring force or both so as to provide a net restoring force that is comparable for different people of different weight.

24. An apparatus as in claim 19, wherein the restoring force acting on the platform in the neutral position or even only slightly displaced from the neutral position can be adjusted via the adjustable spring to be comparable to the restoring force acting on the platform at a position displaced from the neutral position by a significant portion of the range of travel of the platform.

* * * * *

UNITED STATES PATENT AND TRADEMARK OFFICE

CERTIFICATE OF CORRECTION

PATENT NO. : 7,380,881 B2
APPLICATION NO. : 10/869493
DATED : June 15, 2004
INVENTOR(S) : William L. Freed et al.

It is certified that error appears in the above-identified patent and that said Letters Patent is hereby corrected as shown below:

In column 10, line 19, claim 1, line 27, “changes” should be --change--.

In column 11, line 25, claim 11, line 16, “hirizontal” should be --horizontal--.

In column 11, line 27, claim 11, line 18, “changes” should be --change--.

In column 12, line 30, claim 19, line 27, “changes” should be --change--.

Signed and Sealed this

Second Day of September, 2008

JON W. DUDAS
*Director of the United States Patent and Trademark Office*

UNITED STATES PATENT AND TRADEMARK OFFICE

CERTIFICATE OF CORRECTION

PATENT NO. : 7,380,881 B2
APPLICATION NO. : 10/869493
DATED : June 3, 2008
INVENTOR(S) : William L. Freed et al.

It is certified that error appears in the above-identified patent and that said Letters Patent is hereby corrected as shown below:

In column 10, line 19, claim 1, line 27, “changes” should be --change--.

In column 11, line 25, claim 11, line 16, “hirizontal” should be --horizontal--.

In column 11, line 27, claim 11, line 18, “changes” should be --change--.

In column 12, line 30, claim 19, line 27, “changes” should be --change--.

This certificate supersedes the Certificate of Correction issued September 2, 2008.

Signed and Sealed this

Thirtieth Day of September, 2008

JON W. DUDAS
*Director of the United States Patent and Trademark Office*